US007523794B2

(12) United States Patent
Hall et al.

(10) Patent No.: US 7,523,794 B2
(45) Date of Patent: Apr. 28, 2009

(54) WEAR RESISTANT ASSEMBLY

(76) Inventors: David R. Hall, 2185 S. Larsen Pkwy., Provo, UT (US) 84606; Jeff Jepson, 2185 S. Larsen Pkwy., Provo, UT (US) 84606; Ronald Crockett, 2185 S. Larsen Pkwy., Provo, UT (US) 84606; John Bailey, 2185 S. Larsen Pkwy., Provo, UT (US) 84606; Joe Fox, 2185 S. Larsen Pkwy., Provo, UT (US) 84606

( * ) Notice: Subject to any disclaimer, the term of this patent is extended or adjusted under 35 U.S.C. 154(b) by 130 days.

(21) Appl. No.: 11/612,168

(22) Filed: Dec. 18, 2006

(65) Prior Publication Data

US 2008/0142272 A1 Jun. 19, 2008

(51) Int. Cl.
*E21B 10/46* (2006.01)

(52) U.S. Cl. ..... 175/374; 175/426; 299/111; 299/113

(58) Field of Classification Search ..... 175/425, 175/426, 374; 299/104, 105, 111, 113
See application file for complete search history.

(56) References Cited

U.S. PATENT DOCUMENTS

| | | | | | |
|---|---|---|---|---|---|
| 4,951,762 | A * | 8/1990 | Lundell | ..... | 175/420.1 |
| 5,279,375 | A * | 1/1994 | Tibbitts et al. | ..... | 175/428 |
| 6,102,142 | A * | 8/2000 | Besson et al. | ..... | 175/426 |
| 6,131,678 | A * | 10/2000 | Griffin | ..... | 175/434 |
| 6,601,662 | B2 * | 8/2003 | Matthias et al. | ..... | 175/374 |
| 6,739,327 | B2 * | 5/2004 | Sollami | ..... | 125/36 |
| 6,758,530 | B2 * | 7/2004 | Sollami | ..... | 299/111 |

* cited by examiner

*Primary Examiner*—Jennifer H Gay
*Assistant Examiner*—Daniel P Stephenson
(74) *Attorney, Agent, or Firm*—Tyson Wilde

(57) ABSTRACT

In one aspect of the invention, a wear resistant assembly has at least one hard insert disposed within a recess formed within a surface. A hard material substantially surrounds the hard insert and is also disposed within the surface. The hard material is separated from the insert by an intermediate material softer than both the insert and the hard material.

18 Claims, 13 Drawing Sheets

WEAR RESISTANT ASSEMBLY

BACKGROUND OF THE INVENTION

The invention relates to an improved wear resistant assembly that may be used in machinery subject to wear due to abrasive contact, such as crushers, picks, grinding mills, roller cone bits, rotary fixed cutter bits, earth boring bits, percussion bits or impact bits, and drag bits. More particularly, the invention relates to wear resistant assemblies comprising superhard inserts. Such inserts typically comprise a super hard material layer or layers formed under high temperature and pressure conditions, usually in a press apparatus designed to create such conditions, cemented to a carbide substrate containing a metal binder or catalyst such as cobalt. The substrate is often softer than the super hard material to which it is bound. Some examples of super hard materials that high temperature high pressure (HPHT) presses may produce and sinter include cemented ceramics, diamond, polycrystalline diamond, and cubic boron nitride. An insert is normally fabricated by placing a cemented carbide substrate into a container or cartridge with a layer of diamond crystals or grains loaded into the cartridge adjacent one face of the substrate. A number of such cartridges are typically loaded into a reaction cell and placed in the high pressure high temperature press apparatus. The substrates and adjacent diamond crystal layers are then compressed under HPHT conditions which promotes a sintering of the diamond grains to form the polycrystalline diamond structure. As a result, the diamond grains become mutually bonded to form a diamond layer over the substrate face, which is also bonded to the substrate face.

Such inserts are positioned in regions of machinery that are subject to high levels of wear. The inserts then are often subjected to intense forces, torques, vibration, high temperatures and temperature differentials during operation Normally the region surrounding the insert is more susceptible to wear than the insert. As a result, insert stability may be compromised by erosion of the surrounding region long before the expected life of the insert is expired.

U.S. Pat. No. 5,848,657 by Flood et al, which is herein incorporated by reference for all that it contains, discloses domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer.

U.S. Pat. No. 5,417,475 by Graham et al, which is herein incorporated by reference for all that it contains, discloses a breaking or excavating tool that has a diamond and/or cubic boron nitride coated cutting insert mounted at the forward end of a tool body which is made of a softer material than the inert. A separately formed retaining member such as a washer, ring or sleeve, made of harder material than the body, is brazed to a front face of the body surrounding the insert to protect the tool body against wear.

GB Patent No. 2,004,315 by Pietsch, which is herein incorporated by reference for all that it contains, discloses a rock cutting tool comprising a steel shaft having an end portion which tapers towards the end of the shaft and contains a hard metal pin, the said portion being surrounded by a ring of hard metal.

BRIEF SUMMARY OF THE INVENTION

In one aspect of the present invention, a wear resistant assembly comprises at least one hard insert disposed within a recess formed within a surface, a hard material substantially surrounding the hard insert and also disposed within the surface, with the hard material being separated from the insert by an intermediate material softer than both the insert and the hard material. The hard material and/or the insert may be made from steel, stainless steel, carbide, tungsten, tungsten carbide, chromium, gold, silver, a refractory metal, cemented metal carbide, platinum, molybdenum, nickel, iron, aluminum, nitride, stelite, cobalt, manganese, titanium, niobium, or combinations thereof. The hard material and/or the insert may comprise a hardness of at least 60 HRc. The intermediate material may comprise a hardness of between 25 and 50 HRc and may be made from aluminum, titanium, steel, mild steel, hardened steel, stainless steel, chromium, a metallic alloy, or combinations thereof. The intermediate material may comprise a width of 0.01 to 1 inches. The hard material and/or the intermediate material may comprise a height of 0.0001 to 3 inches. The insert and/or the hard material may comprise a coating of super hard material selected from the group consisting of diamond, natural diamond, synthetic diamond, cobalt bonded diamond, polycrystalline diamond, polycrystalline diamond with a binder concentration of 1 to 40 weight percent, cubic boron nitride, refractory metal bonded diamond, silicon bonded diamond, layered diamond, infiltrated diamond, thermally stable diamond, vapor deposited diamond, polished diamond, course diamond, fine diamond, physically deposited diamond, matrix, diamond impregnated matrix, diamond impregnated carbide, cemented metal carbide, chromium, titanium, aluminum, tungsten, niobium, and combinations thereof.

An exposed end of the insert may comprise a generally rounded geometry, a generally conical geometry, a generally flat geometry, a generally hemispherical geometry, or a combination thereof. An exposed end of the hard material and/or intermediate material may comprise a generally flat geometry, a generally polygonal geometry, a generally tapered geometry, a generally rounded geometry, a generally hemispherical geometry, or combinations thereof. The hard material may comprise an enclosed end opposite an end proximate the surface. In some embodiments of the invention at least one of the insert, the hard material, and the intermediate material is flush with the surface. At least one of these components may protrude from the surface 0.001 to 3 inches.

The insert may be brazed or press fit into the intermediate material, which may be brazed or press fit into the hard material. The hard material may be brazed, press fit, glued or bonded into the recess formed within the surface. In some embodiments of the invention the hard material, the intermediate material, and the insert are all disposed within the same recess. The hard material may surround a plurality of inserts in some embodiments of the invention.

The surface may comprise a generally flat geometry, a generally angled geometry, a generally convex geometry, a generally concave geometry, a generally tapered geometry, a generally conical geometry, a generally rounded geometry, a generally hemispherical geometry, or combinations thereof. The surface may be disposed on a wear region of a percussion bit, jaw crusher, hammermill, vertical shaft impactor, cone crusher, roller cone bit, milling machine, chisel, moil, or combinations thereof.

DETAILED DESCRIPTION OF THE INVENTION AND THE PREFERRED EMBODIMENT

Figure 1:
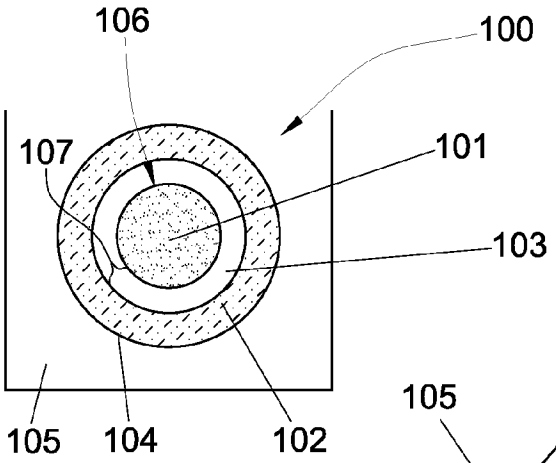
FIG. 1 is a top-view diagram of an embodiment of a wear resistant assembly.
Figure 2:
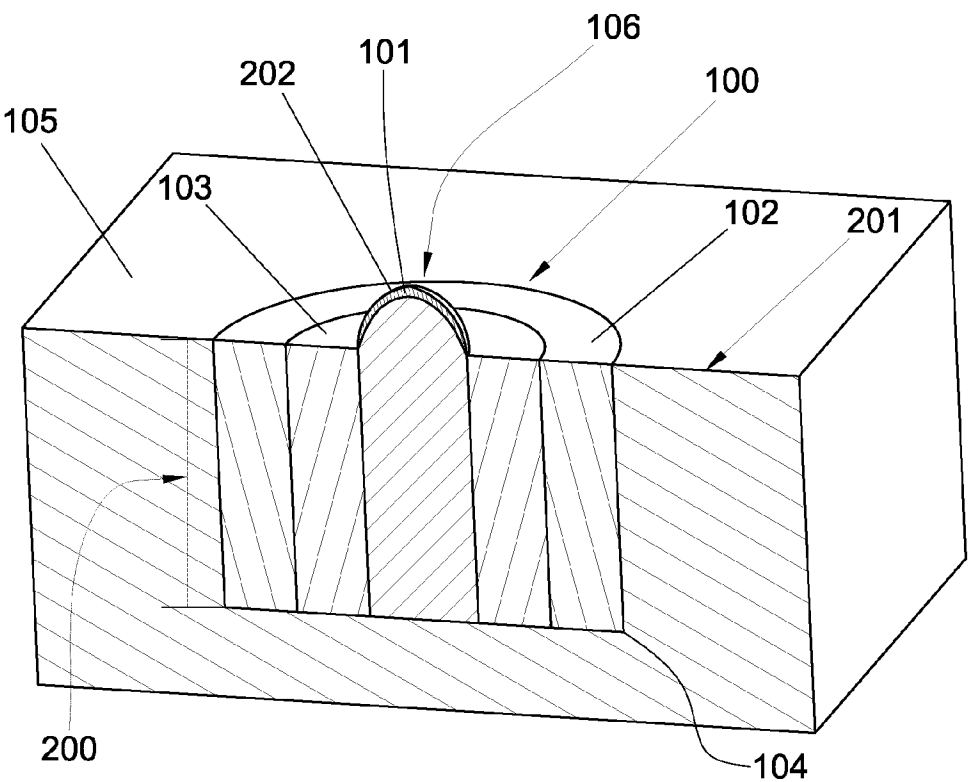
FIG. 2 is a cross sectional diagram of an embodiment of a wear resistant assembly.

FIG. 1 discloses a wear resistant assembly 100 disposed in a recess 104 in a surface 105. The wear resistant assembly 100 comprises a superhard insert 106 which, in some embodiments of the invention, comprises a carbide substrate bonded to a hard coating 101. The wear resistant assembly 100 also comprises a hard material 102 that substantially surrounds the insert 106 and is separated from the insert 106 by an intermediate material 103 that is softer than both the insert 106 and the hard material 102. The intermediate material 103 comprises a width 107 that is the horizontal distance from which the insert 106 is separated from the hard material 102. FIG. 2 is a cross sectional view of an embodiment of a wear resistant assembly 100. Although this embodiment of the invention depicts the hard and intermediate materials 102, 103 shaped in open ended cylinders, any geometry may be used. Preferably the intermediate material 103 has a width 107 of between 0.01 and 1 inch, and each of the intermediate material 103 and hard material 102 have a height 200 of between 0.0001 and 3 inches. In FIG. 2 a cylindrical insert 106 is shown with a protruding, dome-shaped tip 202 at the exposed end 201.

The optimal thickness of the intermediate material may depend on the application in which the wear resistant assembly is used. For example, a thickness of 0.25 inches may be sufficient in milling application where the average sized aggregate being passed over the wear resistant assembly is 0.35 inches thick or greater. Thus in applications where the aggregate is smaller on average the optimal thickness of the intermediate material may be thinner. In one aspect of the invention, the hard material that surrounds the insert is adapted to protect the softer material into which it is inserted. By reducing the wear that the softer material experiences the wear resistant insert is allowed to remain in the surface until the insert wears away instead of falling out prematurely because the surface wore away.

The hard material is generally depicted as a hard cylinder which may surround the insert as well as an intermediate softer material. In other embodiments, the hard material takes the form of a spilt cylinder, a ring, or a coating which may be sprayed or deposited in a recess formed in the surface.

Although the insert 106 in FIG. 2 is shown with a dome-shaped tip 202 at the exposed end 201, the tip 202 at the exposed end 201 may have a generally rounded geometry, a generally conical geometry, a generally flat geometry, a generally hemispherical geometry, or a combination thereof. The insert 106 and the hard material 102 may comprise the same hardness, or their hardness may differ, so long as each comprises a hardness greater than that of the intermediate material 103. It is believed that insert 106 and hard material 102 with a hardness greater than 60 HRc are most effective in preventing wear in highly abrasive rock breaking work. The insert 106 and the hard material 102 each may comprise steel, stainless steel, carbide, tungsten, tungsten carbide, chromium, gold, silver, a refractory metal, cemented metal carbide, platinum, molybdenum, nickel, iron, aluminum, nitride, stelite, cobalt, manganese, titanium, niobium, or combinations thereof.

The intermediate material 103 may be formed from aluminum, titanium, steel, mild steel, hardened steel, stainless steel, chromium, a metallic alloy, or combinations thereof. It is believed that intermediate material 103 that is softer than both the hard material 102 and the insert 106 will allow the insert 106 to be press fit into the hard material 102 without causing excessive strain on the hard material 102 during press fitting. In the process of press fitting large amounts of pressure are applied uniformly on the insert 106 in order to force the insert 106 into a space that is not big enough to receive it without the application of substantial force. Once the insert 106 is fit into the space the friction of the tight fit holds the insert 106 in place. Usually hard materials are also brittle, which makes press fitting an object into a hard material difficult since a brittle material is prone to cracking. It is believed that the softer intermediate material 103 will have a greater tensile strength and therefore help to mediate the stress of press fitting the insert 106 into hard material 102. It is also believed that the intermediate material 103 mediates the stress of press fitting the entire wear resistant assembly 100 into the recess 104 in the surface 105. Preferably the intermediate material has a hardness of between 25 and 50 HRc.

Although we have discussed methods of press fitting the various components of the assembly 100 into one another and into the recess 104, methods of brazing or bonding may also be used. In embodiments where brazing is used a space may be left between the two objects to be brazed for a brazing alloy filler. The brazing alloy filler may comprise copper, silver, nickel, aluminum, gold, tin, zinc, a refractory metal, carbide, tungsten carbide, niobium, titanium, platinum, molybdenum, palladium, silicon, manganese, cobalt, a tape, a foil, a preform, or combinations thereof.

In some embodiments of the invention the insert 106 and/or the hard material 102 may comprise a coating 101 of super hard material selected from the group consisting of diamond, natural diamond, synthetic diamond, cobalt bonded diamond, polycrystalline diamond, polycrystalline diamond with a binder concentration of 1 to 40 weight percent, cubic boron nitride, refractory metal bonded diamond, silicon bonded diamond, layered diamond, infiltrated diamond, thermally stable diamond, vapor deposited diamond, polished diamond, course diamond, fine diamond, physically deposited diamond, matrix, diamond impregnated matrix, diamond impregnated carbide, cemented metal carbide, chromium, titanium, aluminum, tungsten, niobium, stelite, nitride, thin chrome, flash chrome, thick chrome, and combinations thereof. It is believed that this superhard coating 101 extends the life of the wear resistant assembly 100 by protecting the exposed end 201 of the insert 106 and of the hard material 102 to which it may be bonded. The coating 101 may comprise cubic boron nitride or diamond that is arranged in sublayers comprised of different diamond grains having smaller or larger sizes ranging between 0.5 and 300 microns. In some embodiments the smaller diamond grains may be disposed towards the exposed portion of the coating 101 and help to provide a generally harder surface. The larger diamond grains may be disposed closer to the insert 106 and help to provide better elasticity in the coating 101. Better elasticity may reduce delamination or spalling of the coating at an interface with the insert 106, especially as the insert 106 contracts when cooling. While in the press under the HPHT conditions, the metal binder material may infiltrate from the carbide substrate of the insert 106 into the coating 101 which may further assist to promote bonding at the interface. In some embodiments the infiltrated metal binder material may comprise a greater concentration adjacent the interface which gradually diminishes through the remainder of the coating 101. The infiltrated metal binder material may also assist in providing elasticity in the coating 101 at the interface and help to further reduce delamination from the carbide substrate 101 during the cooling process after being formed in a HPHT press. In the embodiment of the invention disclosed in FIG. 1 and FIG. 2 the entire wear resistant assembly 100 is disposed within the same recess 104 of the surface 105.

Figure 3:
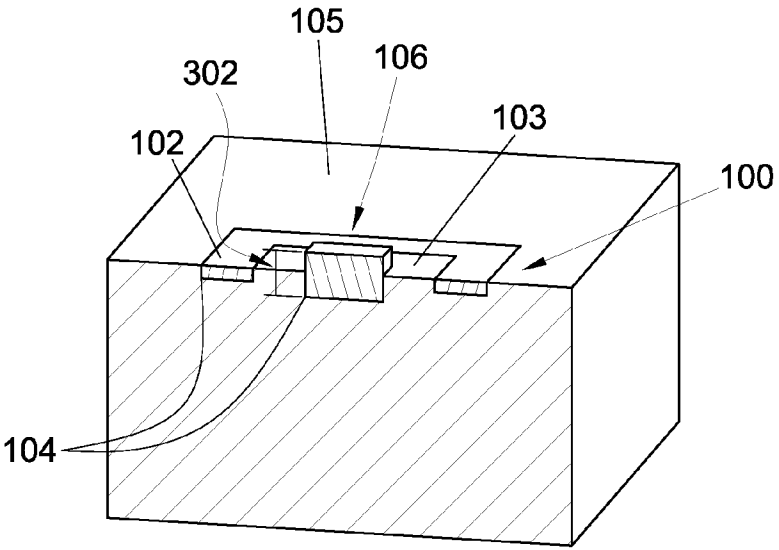
FIG. 3 is a cross sectional diagram of another embodiment of a wear resistant assembly.
Figure 3A:
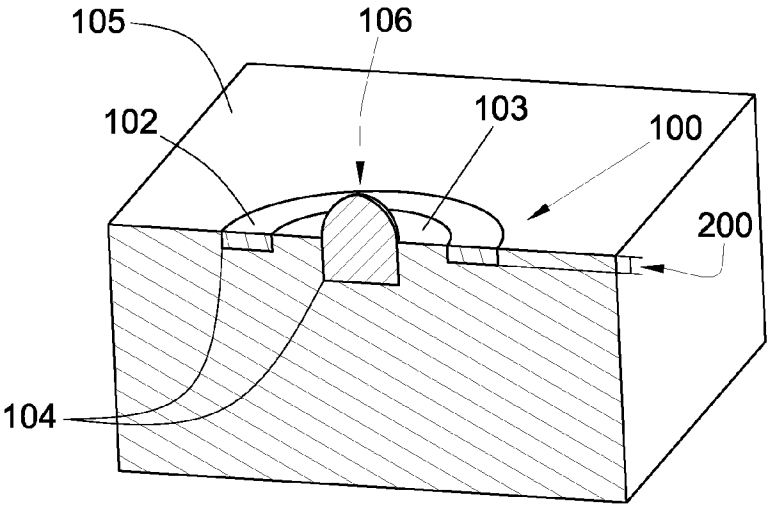
FIG. 3*a* is a cross sectional diagram of another embodiment of a wear resistant assembly.

FIG. 3 and FIG. 3*a* disclose embodiments of the wear resistant assembly 100 in which the hard material 102 is disposed in the same surface 105 as the insert 106, but in a recess 104 separate from the recess 104 in which the insert 106 is disposed. In some embodiments of the invention manufacturing may be simplified by using separate recesses 104. Additionally, FIG. 3 and FIG. 3*a* disclose a hard material with a height 200 that is substantially shorter than the insert's height 302. Hard material height 200 may be adjusted to directly correspond with the wear intensity of the application. In some applications the hard material height 200 required may allow for a shallow groove to be formed around the intermediate material 103 and then to be filled with the hard material 102. Although specific insert 106 and hard and intermediate materials 102, 103 are depicted, any geometry or combination of geometries may be used.

Figure 4:
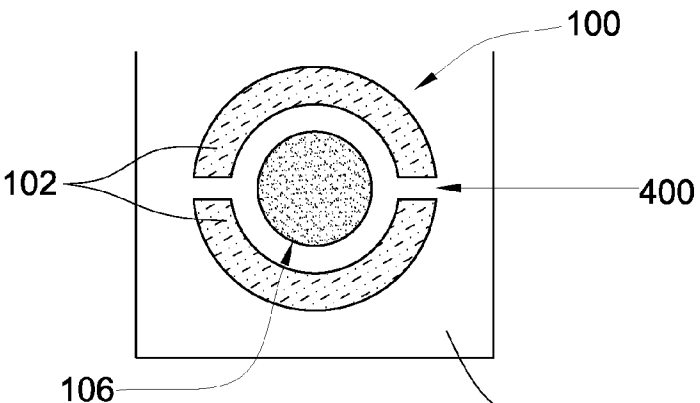
FIG. 4 is a top-view diagram of another embodiment of a wear resistant assembly.

Referring now to FIG. 4, a top view diagram discloses an embodiment of the wear resistant assembly 100 in which a gap 400 exists between two hard materials 102 which each substantially surround the insert 106. For some applications of the invention manufacturing may be simplified by using a plurality of regions of hard materials that surround the insert 106 either each individually or as a group. This aspect of the invention may be especially useful in applications where there is a nonuniform surface 105 that requires a nonuniform distribution of hard material 102. Although FIG. 4 discloses an embodiment of the invention with a gap 400, in other embodiments of the invention the hard material may surround the insert without any substantial gap. In some embodiments the hard material 102 may comprise segments.

Figure 5:
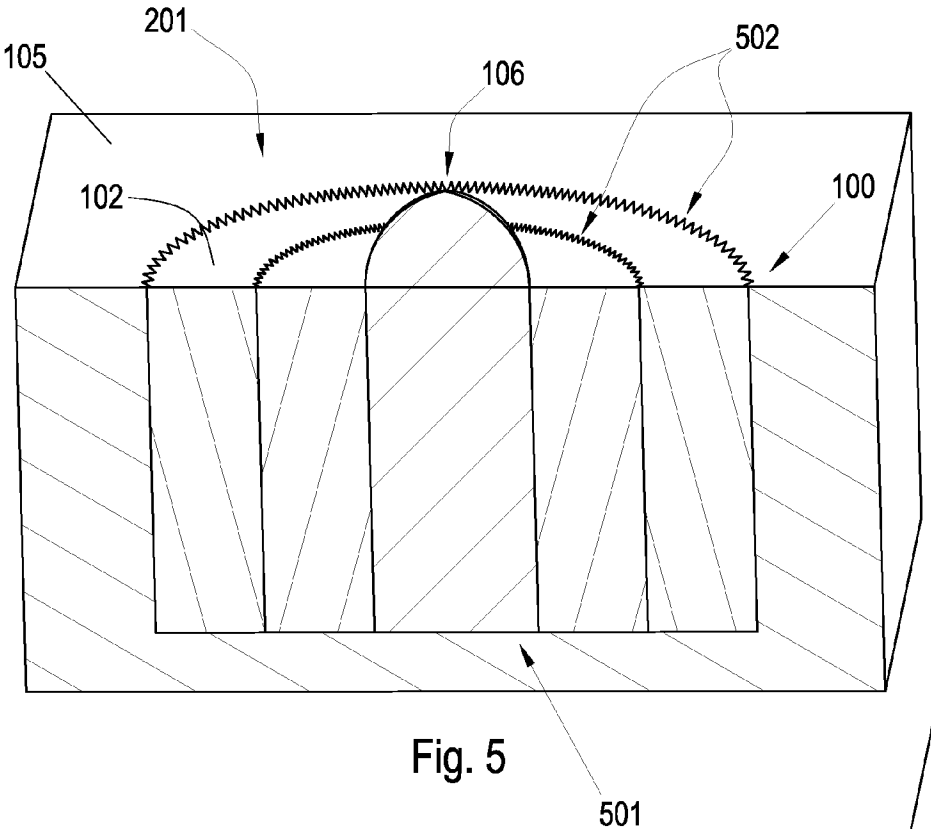
FIG. 5 is a cross sectional diagram of another embodiment of a wear resistant assembly.

FIG. 5 discloses an embodiment of the wear resistant assembly 100 in which both the outer circumference and the inner circumference of the hard material 102 comprise a jagged circumference surface geometry. Though other depictions of embodiments of the invention have been shown with a smooth circumference surface geometry, a jagged circumference surface geometry may be compatible with any embodiment. It is believed that by grinding both the inner and outer circumferences of the hard material 102, and reaming the intermediate material 103 to match, that precision press fitting may be facilitated. In some embodiments, only the hard material will comprise a jagged or serrated periphery. The serrations may form grooves in the surface or the softer intermediate material as it is press fit into place. These grooves may help lock the hard material in the surface.

The embodiment of the invention in FIG. 5 comprises an insert 106 that protrudes from the surface 105. The insert may protrude from the surface 105 0.001 to 3 inches. It is believed that a protruding insert imposes a bending moment on impacting material. This bending moment is believed to increase the crushing force on the impacting material and reduce the energy required to achieve that crushing force.

Figure 6:
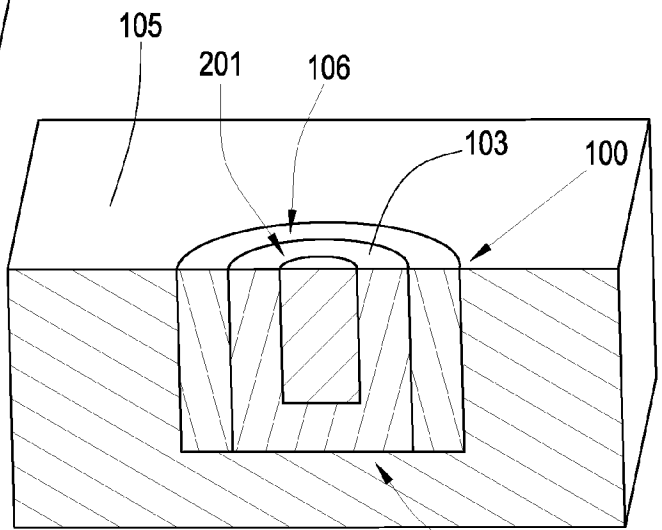
FIG. 6 is a cross sectional diagram of another embodiment of a wear resistant assembly.

Referring now to FIG. 6, a cross sectional diagram of an embodiment of the wear resistant assembly 100 discloses an intermediate material 103 that comprises an enclosed end 501 opposite the exposed end 201. In this embodiment an exposed end 201 of the wear resistant assembly 100 in which the insert 106, the hard material 102, and the intermediate material 103 each comprise a generally flat geometry is shown. Although a flat geometry is shown each component of the exposed end 201 of the wear resistant assembly 100 may comprise a generally flat geometry, a generally polygonal geometry, a generally tapered geometry, a generally rounded geometry, a generally hemispherical geometry, a generally irregular geometry, or combinations thereof.

Figure 7:
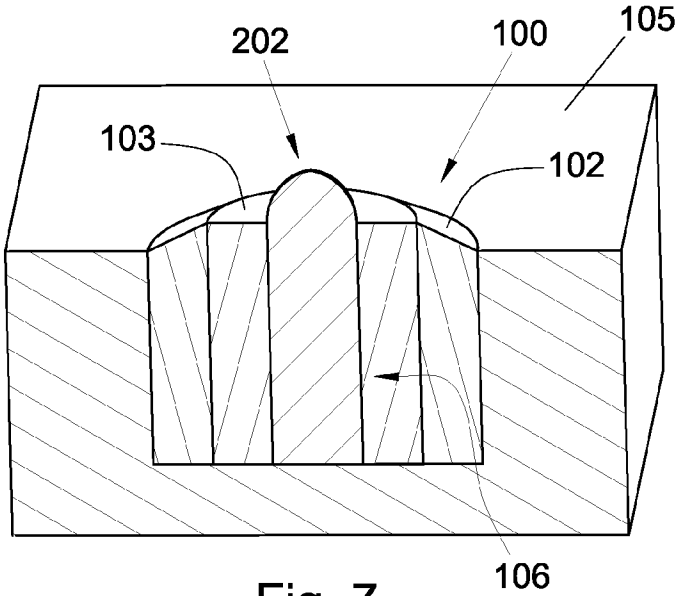
FIG. 7 is a cross sectional diagram of another embodiment of a wear resistant assembly.

FIG. 7 discloses an embodiment of the invention in which the hard material 102 protrudes from the surface 105 and comprises a generally slanted geometry. In applications where a protruding insert 106 is used, hard material 102 that is flush with the surface 105 may leaves a larger region of the insert 106 exposed to wear. Hard material 102 with a slanted geometry is believed to allow the wear resistant assembly 100 to protect the surface 105 surrounding the insert 106 from wear starting at a level flush with the surface 105 and continuing to a level closer to the tip 202 of the insert 106. Because sharp edges are believed to be more vulnerable to wear, the intermediate material 103 may be flush with the higher end of the slanted hard material 102.

Figure 8:
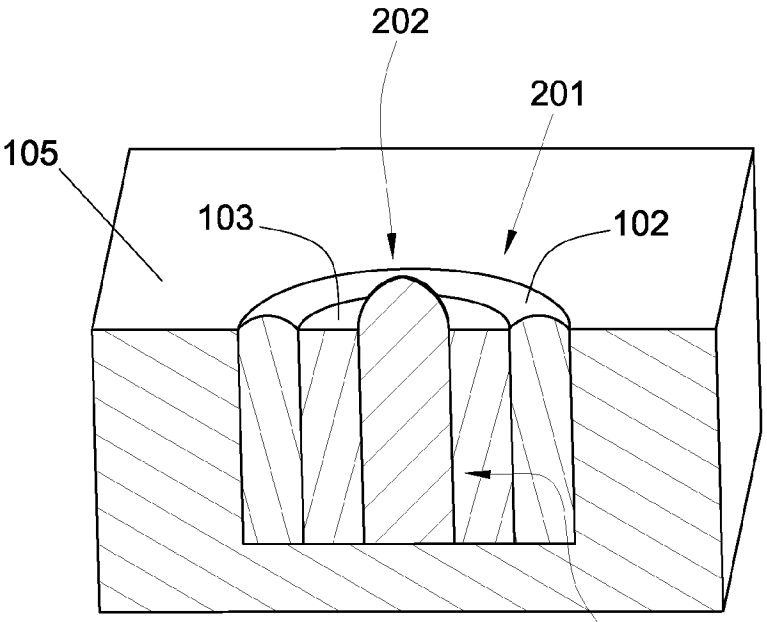
FIG. 8 is a cross sectional diagram of another embodiment of a wear resistant assembly.

Referring now to FIG. 8, an exposed end 201 of the hard material 102 may have a generally rounded geometry. It is believed that a generally rounded geometry may be less vulnerable to fracture from impact forces. In embodiments of the invention in which the hard material 102 rounds upward forming a raised barrier around the insert and the intermediate material 103 is flush with the surface 105, it is believed that this region will fill with aggregate from the material being crushed, thus protecting the intermediate material 103 and some of the exposed regions of the insert 106 and the hard material 102. In such embodiments the tip 202 of the insert 106 may still have a height greater than the height of the hard material 102.

Figure 9:
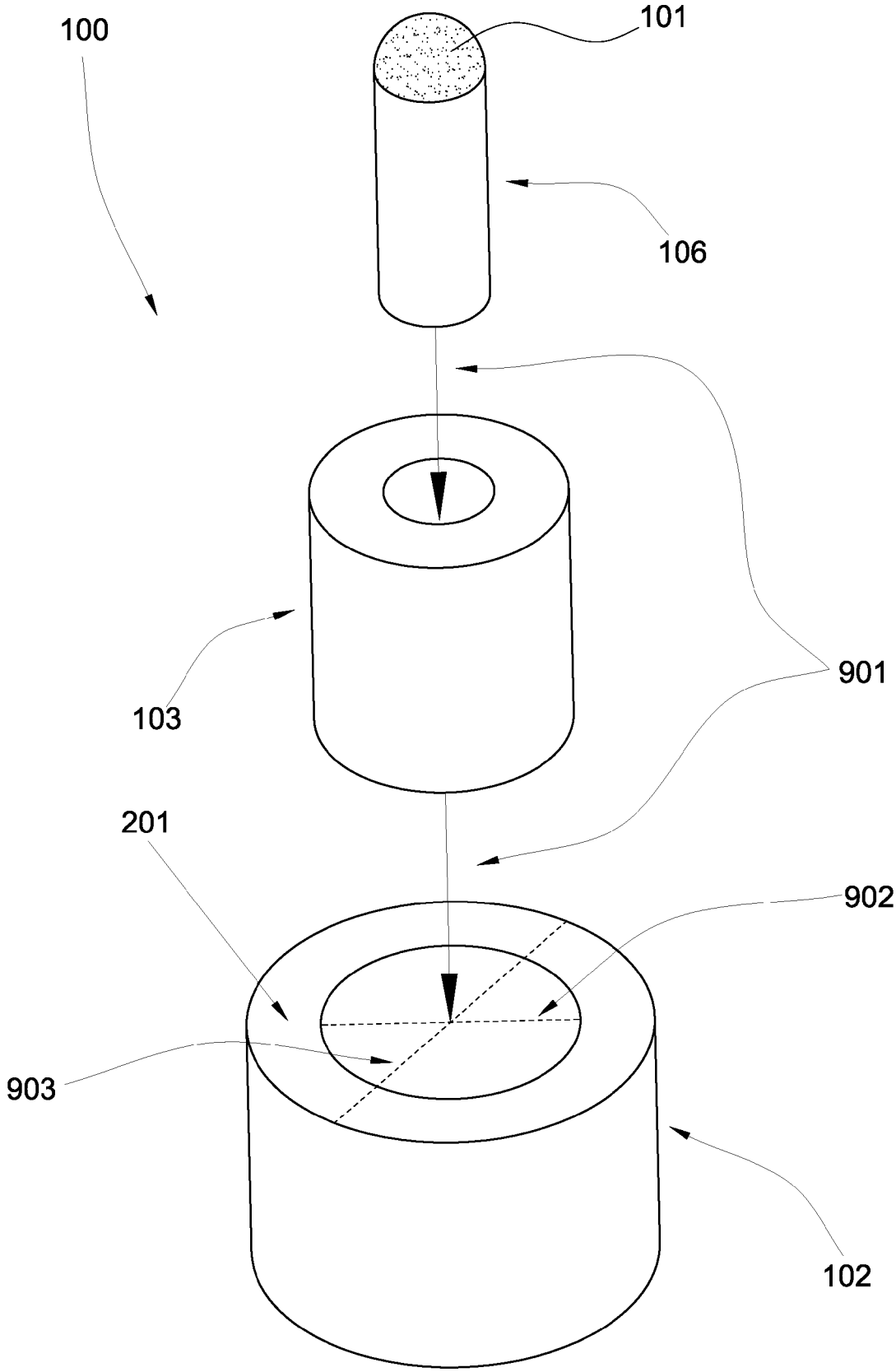
FIG. 9 is an exploded view diagram of an embodiment of a wear resistant assembly.

Referring now to FIG. 9, an exploded view of an embodiment of a wear resistant assembly 100 is shown with an insert 106, an intermediate material 103 and a hard material 102. In this embodiment each of these three components comprises a generally cylindrical geometry with a central axis generally parallel to one another. The components may be inserted in the direction indicated by the arrows 901 in order to form the wear resistant assembly 100. The wear resistant assembly 100 may be inserted into the surface 105 either as an entire piece or in multiple pieces. This embodiment of the wear resistant assembly 100 depicts a hard material 102 comprising an inner diameter 902 and an outer diameter 903. The intermediate material 103 also comprises inner and outer diameters 902, 903. The area of the exposed end 201 of the hard material 102 may be increased by increasing the outer diameter 903 without an equivalent increase in the inner diameter 902.

Figure 10:
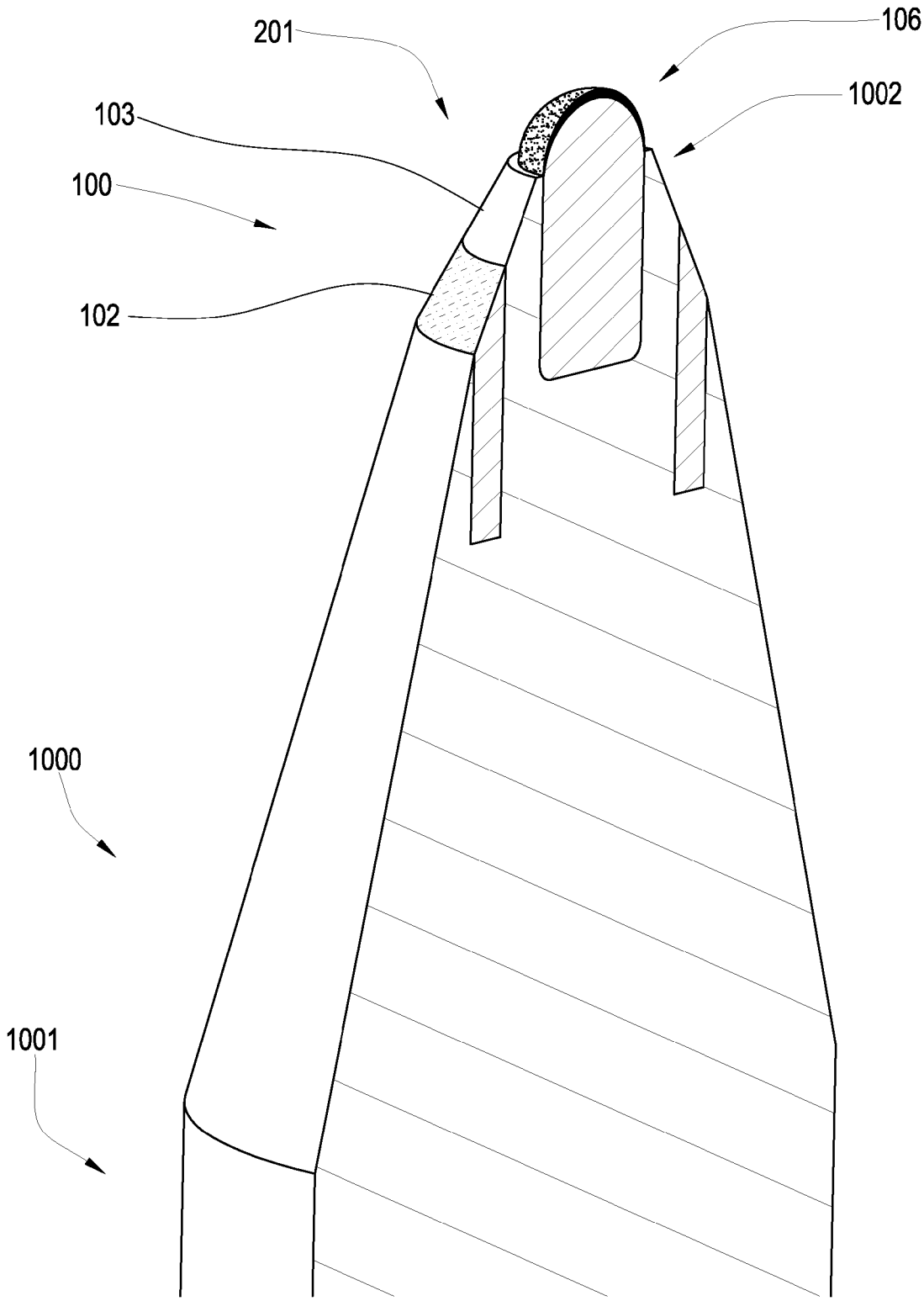
FIG. 10 is a cross sectional diagram of another embodiment of a wear resistant assembly.
Figure 11:
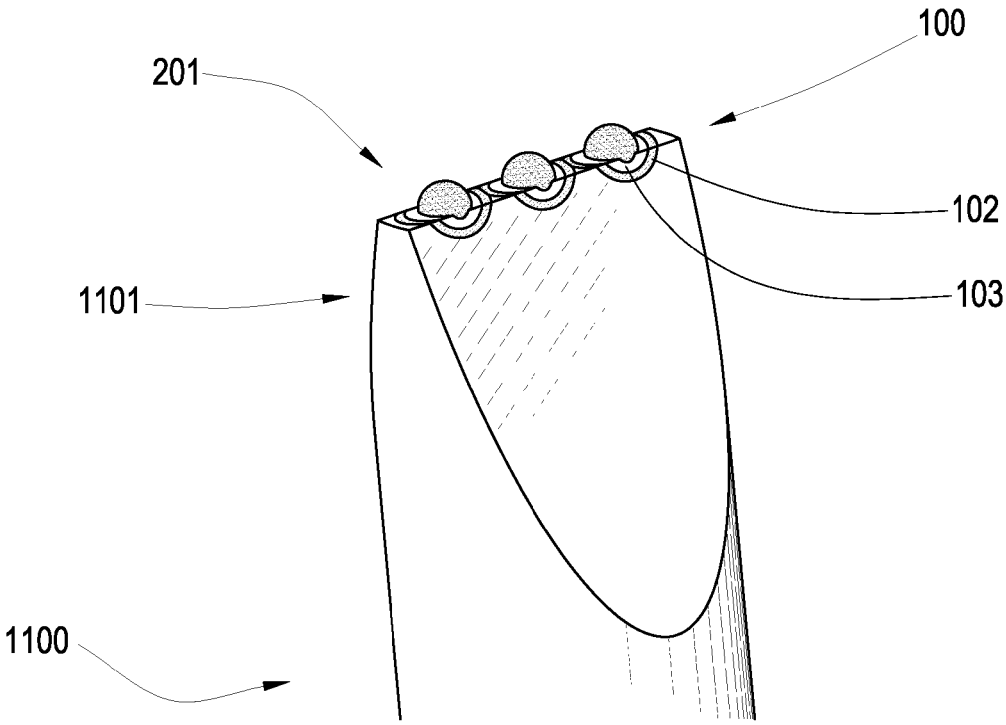
FIG. 11 is a perspective diagram of an embodiment of a wear resistant assembly incorporated in a chisel.
Figure 12:
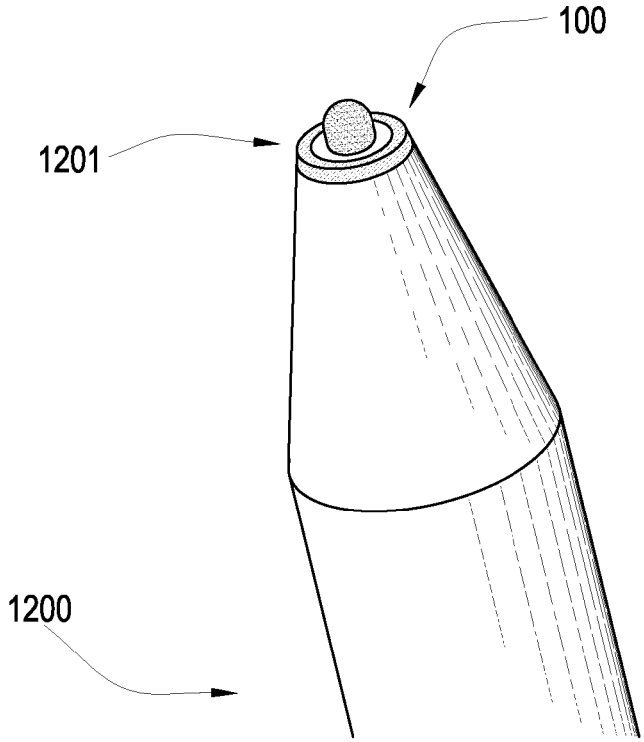
FIG. 12 is a perspective diagram of another embodiment of a wear resistant assembly incorporated in a moil.

FIGS. 10-18 disclose the current invention depicting the wear resistant assembly 100 within various embodiments. In FIG. 10 an embodiment of a wear resistant assembly 100 is shown disposed on the end of a pick 1000. The exposed end 201 of both the hard material 102 and the intermediate material 103 are tapered at an angle from the shaft 1001 of the pick 1000 to the tip 1002. It is believed that the tapering presents a uniform and continuous wear resistant region to protect the integrity of the insert 106 without interfering with the operation of the pick 1000. FIG. 11 discloses a plurality of wear resistant assemblies 100 disposed on the end 1101 of a chisel 1100. In this embodiment the exposed end 201 of the hard material 102 and the intermediate material 103 have an irregular geometry. FIG. 12 discloses an embodiment of a wear resistant assembly 100 disposed on the tip 1201 of a moil 1200. Although a specific embodiment of the wear resistant assembly 100 has been shown disposed on the moil 1200 in a certain location and manner, any embodiment of the invention may be disposed in any way on the moil 1200 or on any other surface.

Figure 13:
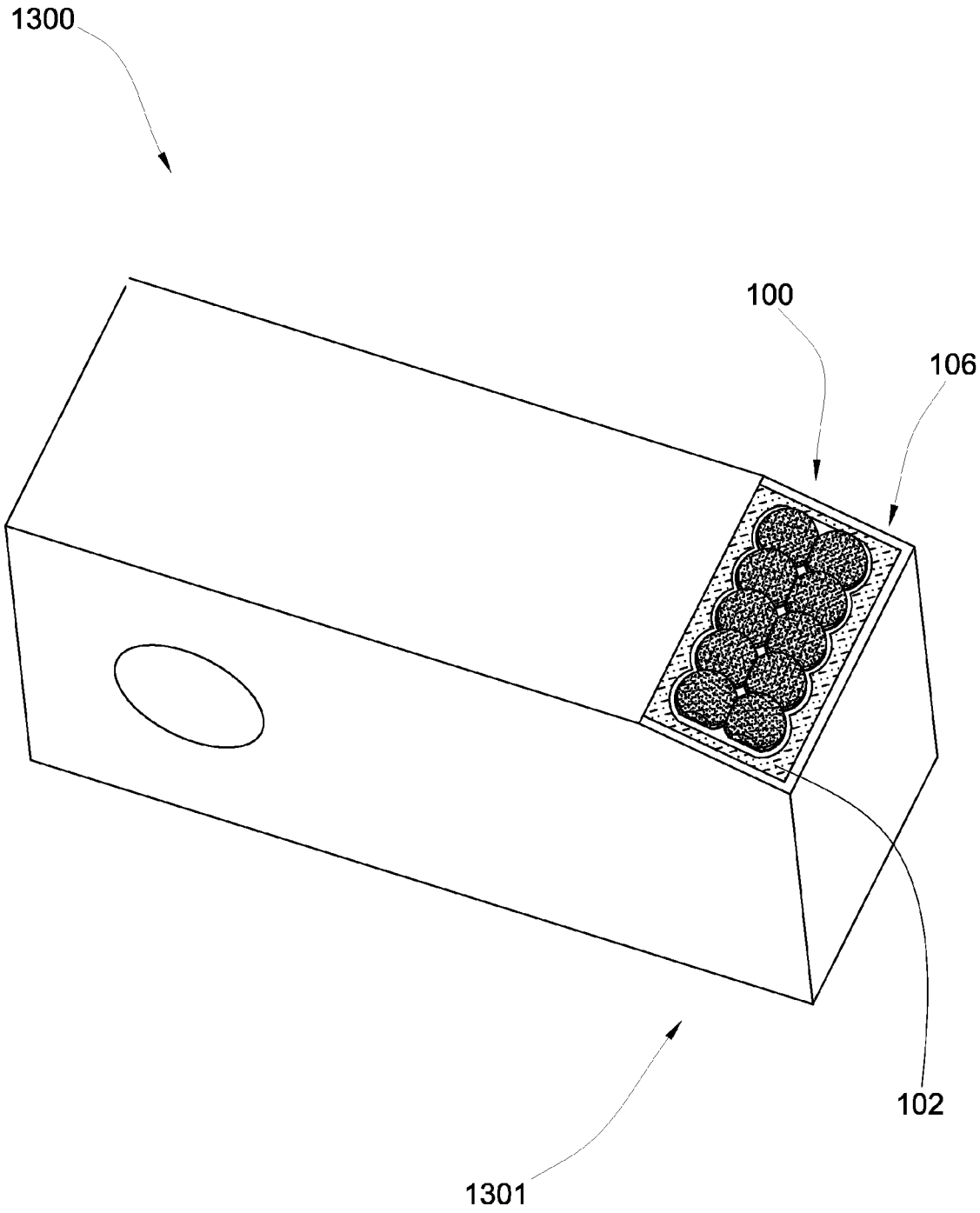
FIG. 13 is a perspective diagram of another embodiment of a wear resistant assembly incorporated in a hammer.
Figure 14:
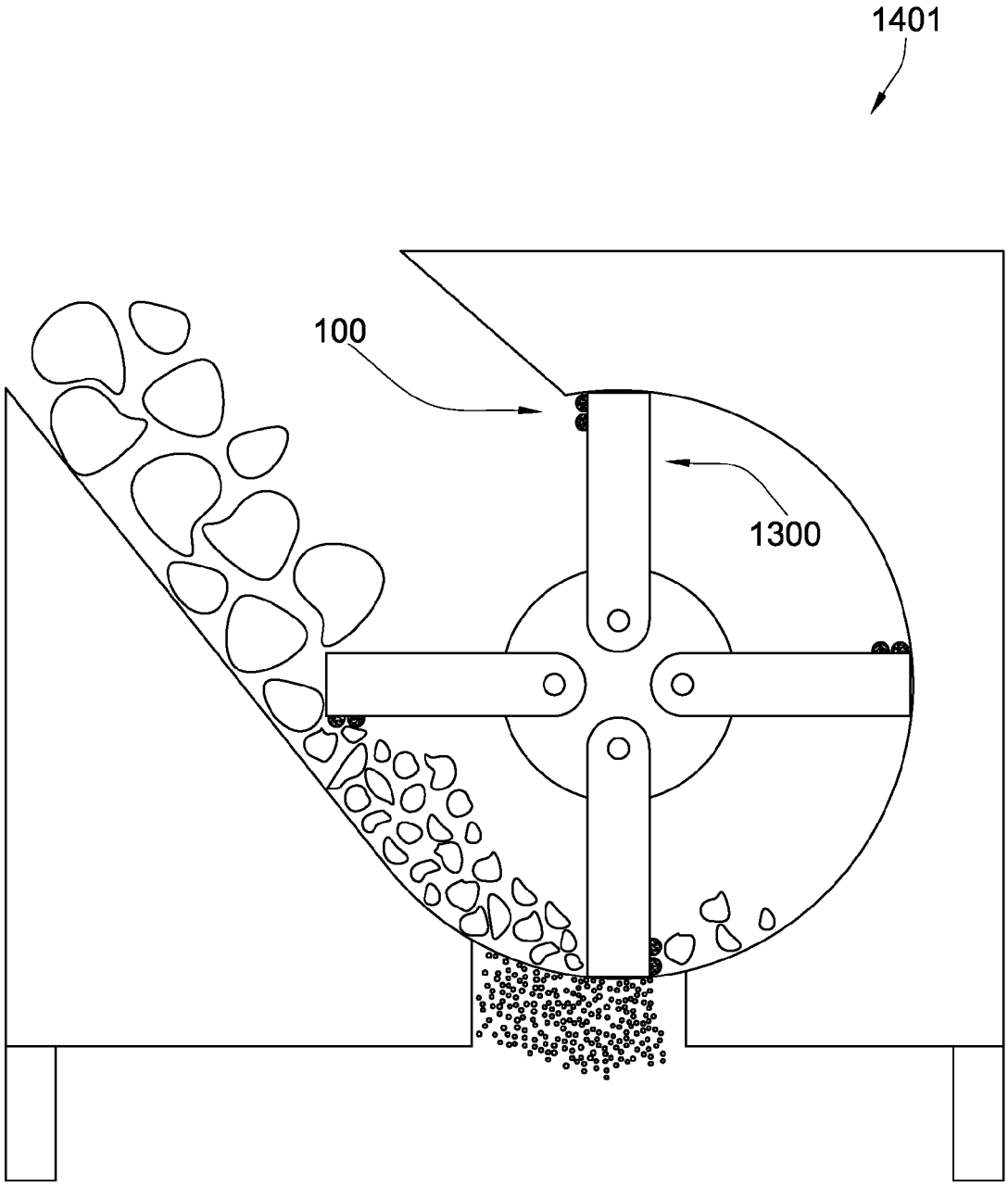
FIG. 14 is a perspective diagram of a hammermill consistent with incorporation of a wear resistant assembly.

FIG. 13 discloses an embodiment of a wear resistant assembly 100 disposed on the distal end 1301 of a hammer 1300. This embodiment discloses a single hard material 102 that surrounds a plurality of inserts 106. This embodiment allows for placement of complementary inserts 106 immediately adjacent one another such that they may compress together laterally and/or reduce wear between themselves by reducing the ability of aggregate to move between them. Referring now to FIG. 14, the wear resistant assembly 100 may be disposed on a hammer 1300 that may be incorporated into a hammermill 1401.

Figure 15:
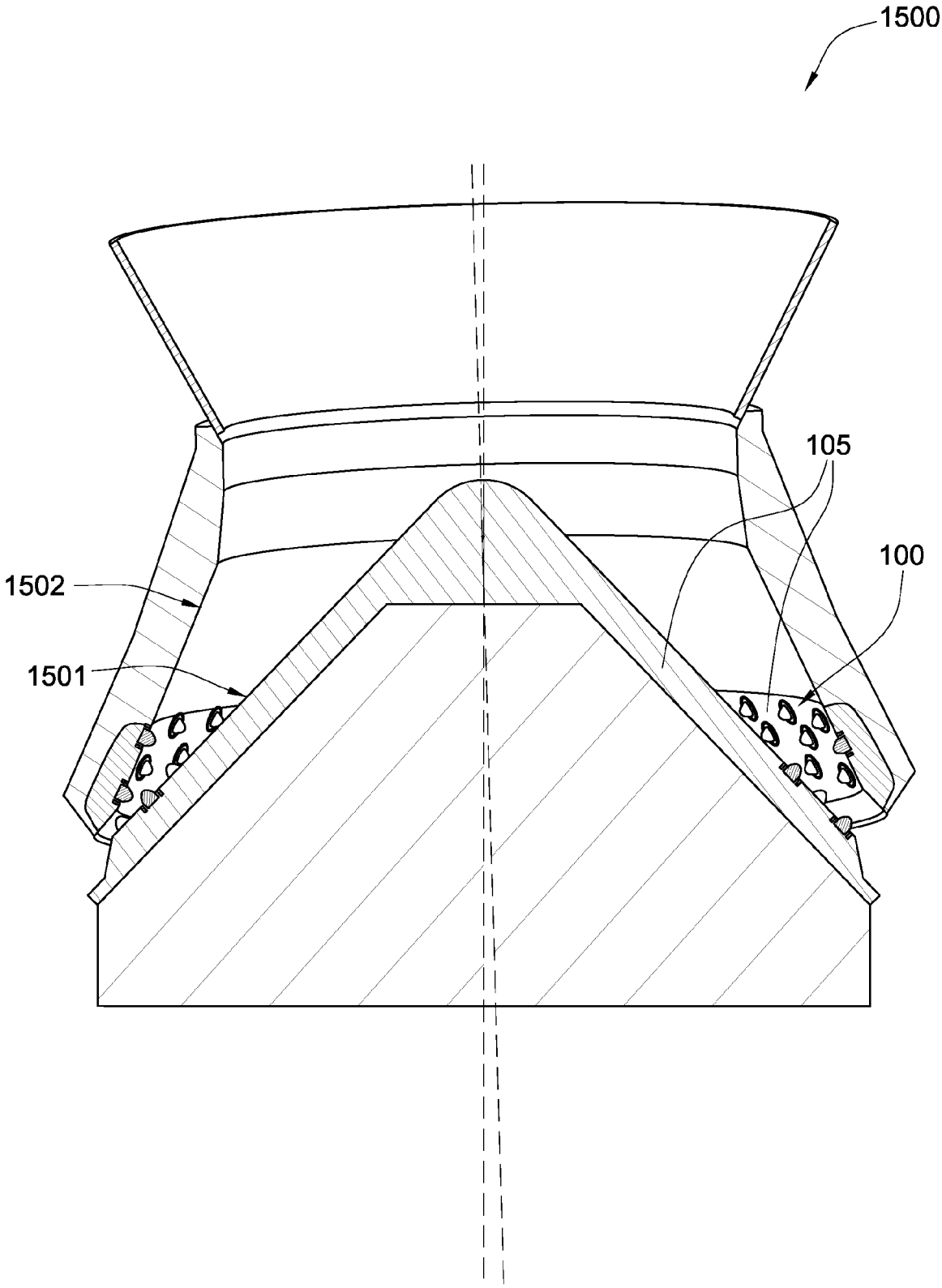
FIG. 15 is a perspective diagram of another embodiment of a wear resistant assembly incorporated in a cone crusher

FIG. 15 discloses an embodiment of a cone crusher 1500 which incorporates a plurality of wear resistant assemblies 100. The plurality of wear resistant assemblies 100 may be disposed on the convex surface of the cone 1501 and/or on the concave surface of the bowl 1502. Although FIG. 15 depicts the plurality of wear resistant assemblies 100 at specific regions and on specific surfaces 105 of the cone crusher 1500, the wear resistant assemblies may be disposed in any region and on any surface 105 of a cone crusher 1500 or of any machine.

Figure 16:
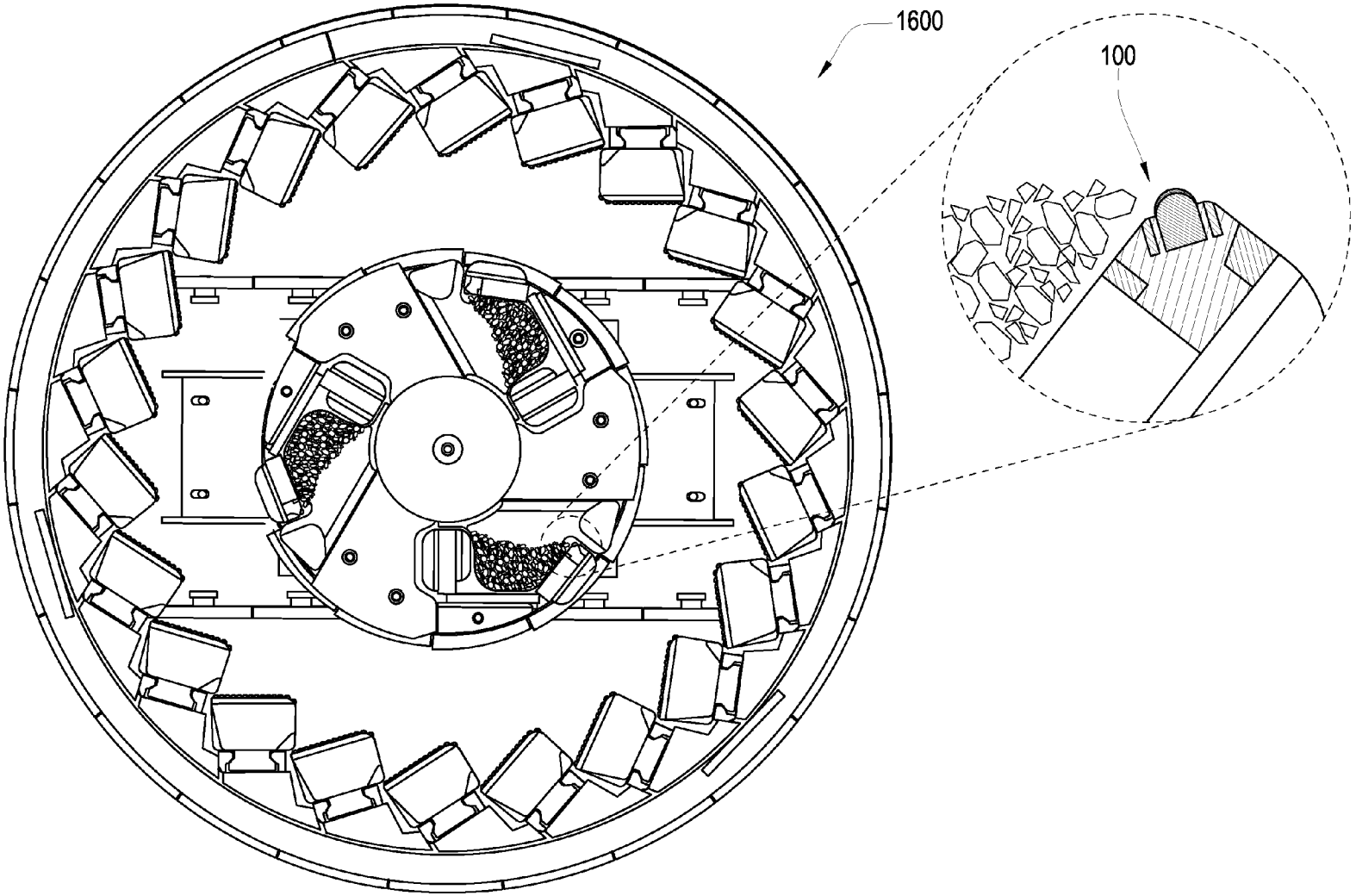
FIG. 16 is a perspective diagram of another embodiment of a wear resistant assembly incorporated in a vertical shaft impactor.
Figure 17:
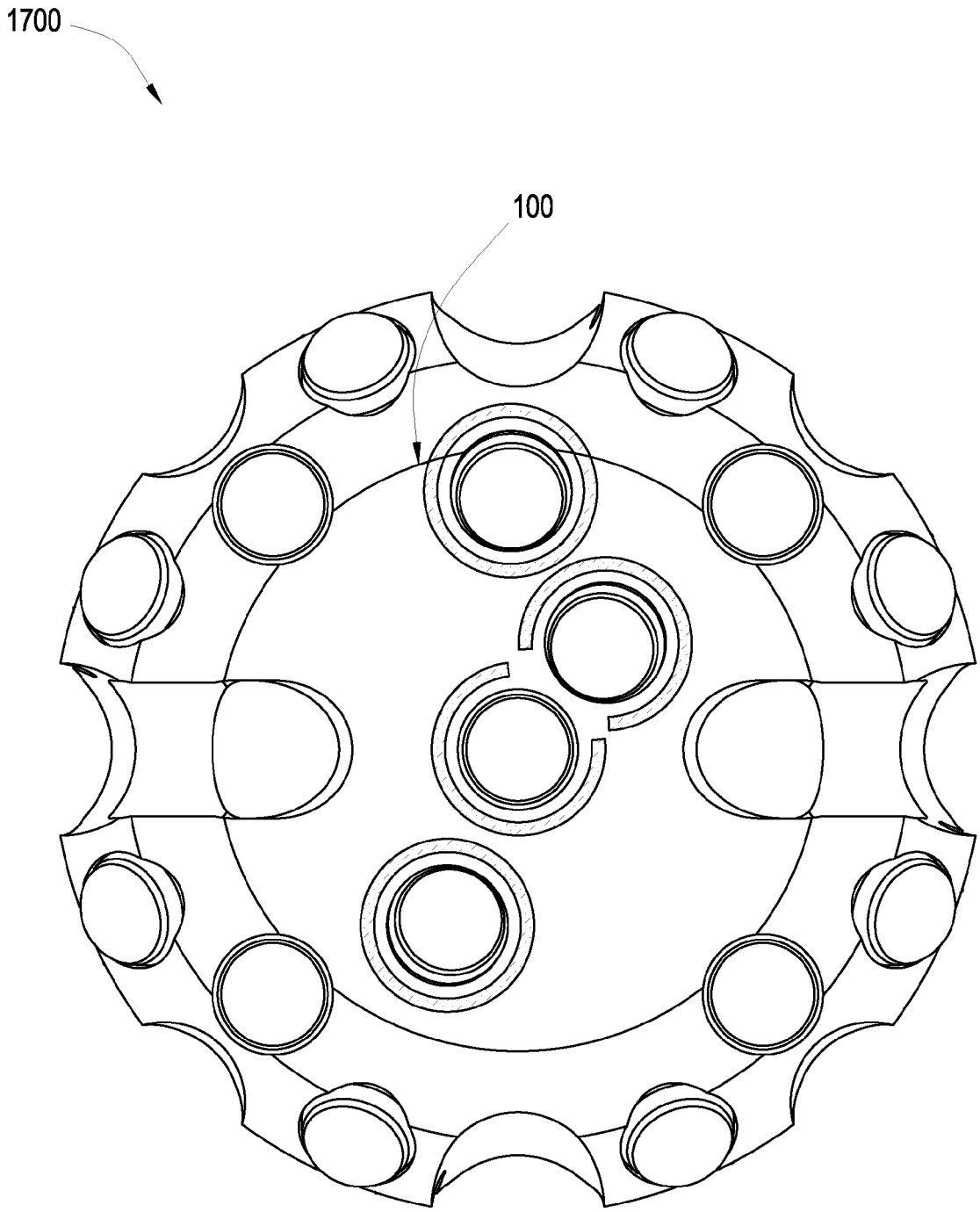
FIG. 17 is a perspective diagram of another embodiment of a wear resistant assembly incorporated in a percussion bit.
Figure 18:
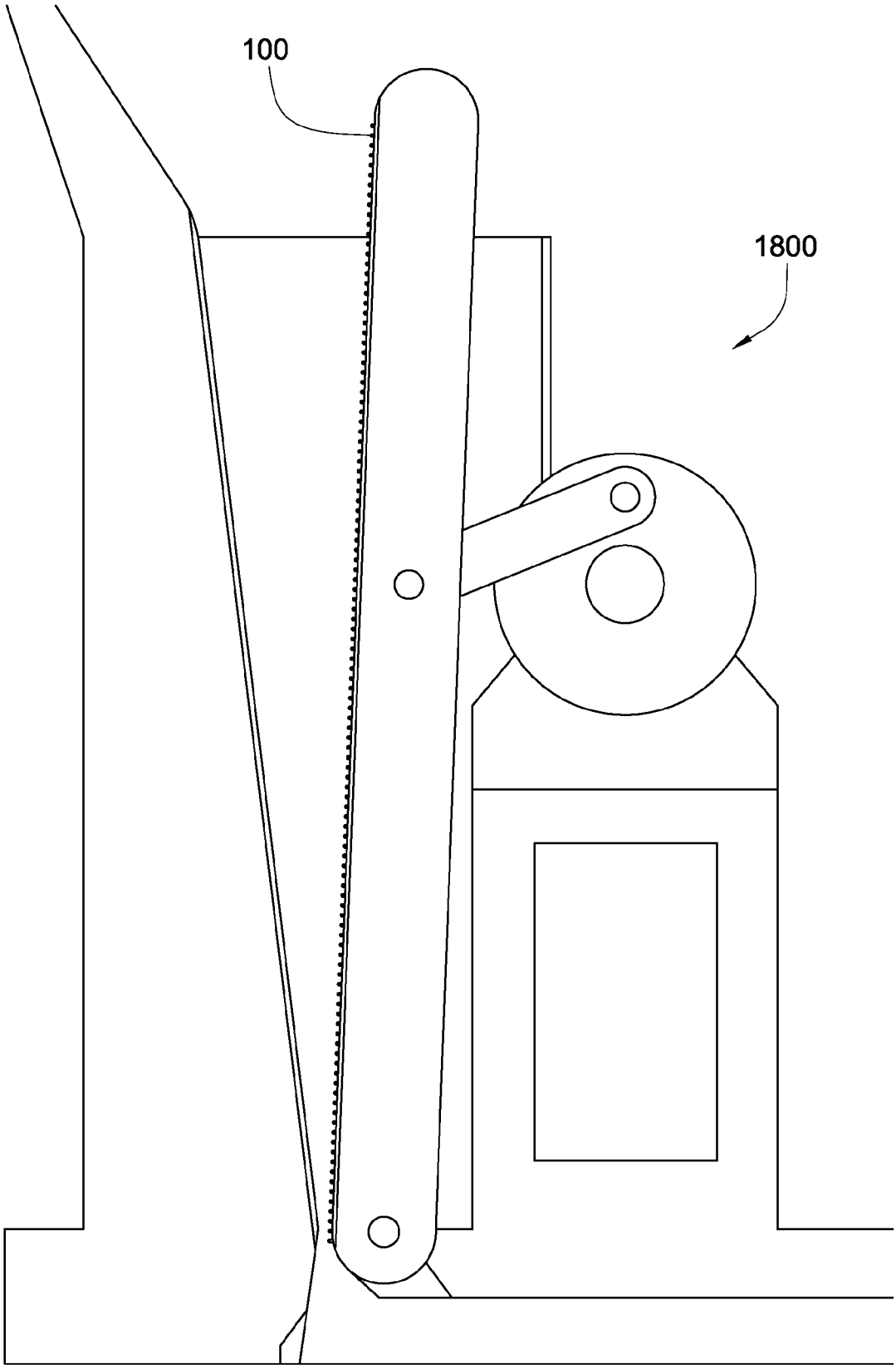
FIG. 18 is a perspective diagram of incorporated in a jaw crusher consistent with incorporation of a wear resistant assembly

FIG. 16 discloses an embodiment of a vertical shaft impactor 1600 which incorporates a wear resistant assembly 100 and may incorporate a plurality of wear resistant assemblies 100. For every embodiment where a single wear resistant assembly 100 has been suggested an embodiment may exist that comprises a plurality of wear resistant assemblies. FIG. 17 discloses an embodiment of a percussion bit 1700 which incorporates a plurality of wear resistant assemblies 100. Although a plurality of wear resistant assemblies 100 has been shown some embodiments may include only one wear resistant assembly 100. As shown some of the hard material is in the form of a split ring. FIG. 18 discloses an embodiment of a jaw crusher 1800 which may incorporate an embodiment of a wear resistant assembly 100. Though specific crushing machines incorporating the wear resistant assembly 100 have been shown embodiments of the present invention may be adapted to other rock crushing machines, as well as other surfaces. The surface may comprise a generally flat geometry, a generally angled geometry, a generally convex geometry, a generally concave geometry, a generally tapered geometry, a generally conical geometry, a generally rounded geometry, a generally hemispherical geometry, or combinations thereof.

Whereas the present invention has been described in particular relation to the drawings attached hereto, it should be understood that other and further modifications apart from those shown or suggested herein, may be made within the scope and spirit of the present invention.

What is claimed is:

1. A wear resistant assembly, comprising:

a plurality of hard inserts being press-fit within a recess formed within a surface;

a hard material substantially surrounding the hard inserts and also being press-fit within the surface;

the hard material being separated from the insert by an intermediate material softer than both the inserts and the hard material;

wherein the intermediate material comprises a hardness of between 25 and 50 HRc.

2. The wear resistant assembly of claim 1, wherein the hard material and/or the inserts comprise material selected from the group consisting of steel, stainless steel, carbide, tungsten, tungsten carbide, chromium, gold, silver, a refractory metal, cemented metal carbide, platinum, molybdenum, nickel, iron, aluminum, nitride, stelite, cobalt, manganese, titanium, niobium, and combinations thereof.

3. The wear resistant assembly of claim 1, wherein the hard material and/or the inserts comprise a hardness of at least 60 HRc.

4. The wear resistant assembly of claim 1, wherein the intermediate material comprises material from the group consisting of aluminum, titanium, steel, mild steel, hardened steel, stainless steel, chromium, a metallic alloy, and combinations thereof.

5. The wear resistant assembly of claim 1, wherein the intermediate material comprises a width of 0.01 to 1 inches.

6. The wear resistant assembly of claim 1, wherein the hard material and/or the intermediate material comprises a height of 0.0001 to 3 inches.

7. The wear resistant assembly of claim 1, wherein the inserts and/or the hard material comprises a coating of super hard material selected from the group consisting of diamond, natural diamond, synthetic diamond, cobalt bonded diamond, polycrystalline diamond, polycrystalline diamond with a binder concentration of 1 to 40 weight percent, cubic boron nitride, refractory metal bonded diamond, silicon bonded diamond, layered diamond, infiltrated diamond, thermally stable diamond, vapor deposited diamond, polished diamond, course diamond, fine diamond, physically deposited diamond, matrix, diamond impregnated matrix, diamond impregnated carbide, cemented metal carbide, chromium, titanium, aluminum, tungsten, niobium, and combinations thereof.

8. The wear resistant assembly of claim 1, wherein an exposed end of the inserts comprise a generally rounded geometry, a generally conical geometry, a generally flat geometry, a generally hemispherical geometry, or a combination thereof.

9. The wear resistant assembly of claim 1, wherein an exposed end of the hard material and/or intermediate material comprise a generally flat geometry, a generally polygonal geometry, a generally tapered geometry, a generally rounded geometry, a generally hemispherical geometry, or combinations thereof.

10. The wear resistant assembly of claim 1, wherein the hard material comprises an enclosed end opposite an end proximate the surface.

11. The wear resistant assembly of claim 1, wherein at least one of the inserts, the hard material, and the intermediate material is flush with the surface.

12. The wear resistant assembly of claim 1, wherein at least one of the inserts, the hard material, and the intermediate material protrudes from the surface 0.001 to 3 inches.

13. The wear resistant assembly of claim 1, wherein the hard material, the intermediate material, and the inserts are all disposed within the same recess.

14. The wear resistant assembly of claim 1, wherein the surface comprises a generally flat geometry, a generally angled geometry, a generally convex geometry, a generally concave geometry, a generally tapered geometry, a generally conical geometry, a generally rounded geometry, a generally hemispherical geometry, or combinations thereof.

15. The wear resistant assembly of claim 1, wherein the surface is disposed on a wear region of a percussion bit, jaw crusher, hammermill, vertical shaft impactor, cone crusher, roller cone bit, milling machine, chisel, moil, or combinations thereof.

16. The wear resistent assembly of claim 1, wherein the hard material comprises a rounded geometry adapted to reduce the vulnerability from impact forces.

17. The wear resistent assembly of claim 1, wherein the hard material will comprise a jagged or serrated circumference surface.

18. The wear resistent assembly of claim 1, wherein the hard material comprises a hardness substantially greater than the hardness of the inserts.

* * * * *